United States Patent [19]

Dierichs et al.

[11] Patent Number: 4,696,836

[45] Date of Patent: Sep. 29, 1987

[54] HAND STAMP METHOD FOR APPLYING ADHESIVES

[75] Inventors: Wolfgang Dierichs, Duesseldorf; Gerhard Gierenz, Solingen; Gabriella Kraus, Neuss, all of Fed. Rep. of Germany

[73] Assignee: Henkel Kommanditgesellschaft auf Aktien, Duesseldorf, Fed. Rep. of Germany

[21] Appl. No.: 847,417

[22] Filed: Apr. 2, 1986

[30] Foreign Application Priority Data

Apr. 10, 1985 [DE] Fed. Rep. of Germany ..... 3512818

[51] Int. Cl.[4] ..... B05D 5/10

[52] U.S. Cl. ..... 427/208.4; 101/426; 427/207.1

[58] Field of Search ..... 427/208.4, 207.1; 101/426

*Primary Examiner*—Bernard D. Pianalto

*Attorney, Agent, or Firm*—Ernest G. Szoke; Henry E. Millson, Jr.

[57] ABSTRACT

The invention relates to a hand stamp adhesive applicator and method for applying a liquid adhesive to a defined area on a surface. The applicator includes a housing, an adhesive transfer stamp pad, a container, an adhesive applying stamp body, and a support mechanism for the stamp body. The housing includes a base and an upper part coupled to, and vertically displaceable with respect to, the base. The adhesive transfer stamp pad is supported in the housing and formed of a material permeable to the liquid adhesive. The container is also supported in the housing above, and in fluid communication with, the stamp pad. The adhesive applying stamp body applies the liquid adhesive to the defined area of the surface; and the support mechanism supports the adhesive applying stamp body in the housing for motion between an upwardly facing inoperative position to receive the liquid adhesive from the adhesive transfer stamp pad and a downwardly facing operative position to apply the liquid adhesive to the surface.

Solutions and/or dispersions of the adhesive-type polymers activated by the liquid phase of the adhesive used are particularly suitable as liquid adhesives.

16 Claims, 6 Drawing Figures

FIG.1
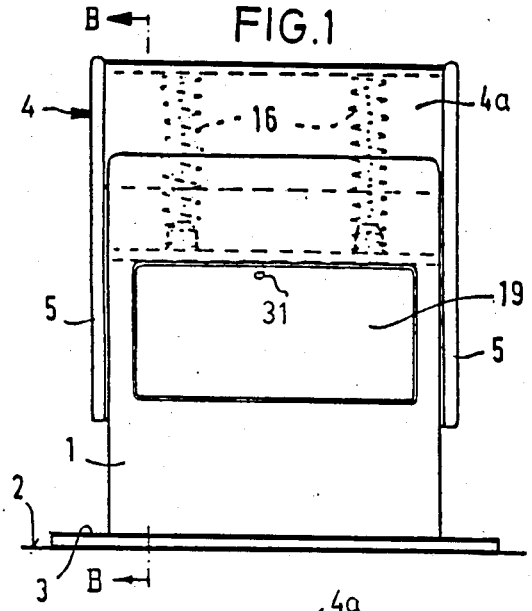
FIG.2
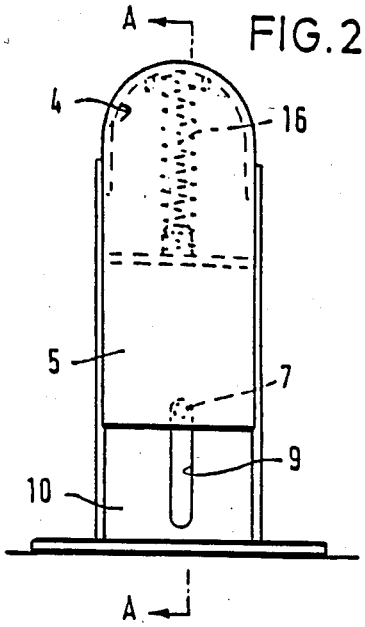
FIG.3
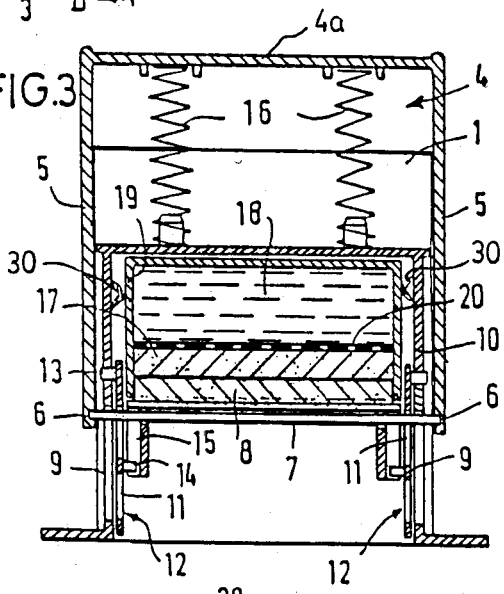
FIG.4
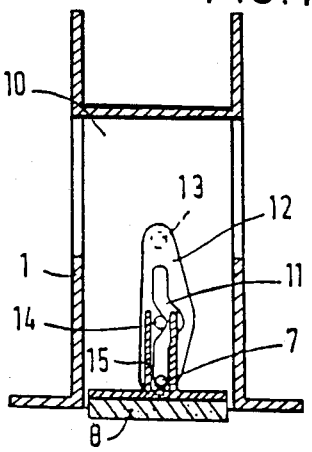
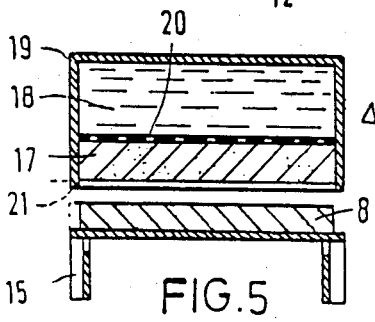
FIG.5
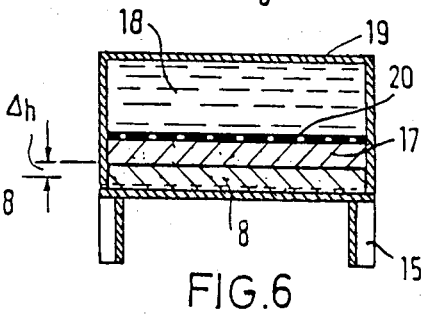
FIG.6

HAND STAMP METHOD FOR APPLYING ADHESIVES

BACKGROUND OF THE INVENTION

1. Field of the Invention

This invention relates to a method and apparatus for applying an adhesive to a surface, and more particularly, to a hand stamp type of adhesive applicator and its use wherein a container of liquid adhesive is supported in the applicator, the adhesive from the container is transferred from an adhesive transfer stamp pad to an adhesive applying stamp body, and the stamp body applies the adhesive to the surface.

2. Description of Related Art

A hand stamp is known which has a reversible stamp body that, in an inoperative position, adjoins an ink-filled stamp pad. When the hand stamp is moved at a right-angle to the surface to be stamped, the stamp body moves away from the stamp pad and rotates 180° before reaching the surface to be stamped. Further downward motion of the hand stamp presses the stamp body against surface to be stamped and prints the desired indicia on the surface.

BRIEF DESCRIPTION OF THE DRAWINGS

FIG. 1 is a front elevation of a hand stamp adhesive applicator according to the invention in an inoperative position.

FIG. 2 is a side elevation of the hand stamp adhesive applicator shown in FIG. 1.

FIG. 3 is a vertical section taken generally along line A—A of FIG. 2.

FIG. 4 is a vertical section taken generally along line B—B of FIG. 1, with certain parts left out to illustrate more clearly the drive mechanism of a stamp body in the operative position.

FIG. 5 is a vertical section illustrating a stamp pad and the stamp body before coming into contact with one another.

FIG. 6 is a vertical section illustrating the stamp pad and the stamp body in an inoperative position of the hand stamp adhesive applicator.

DESCRIPTION OF THE INVENTION

It has unexpectedly been found that a hand stamp which has been widely used as a date or address stamp, may be adapted for use as an adhesive applicator to apply an adhesive to a surface. Such an adhesive applicator is particularly useful when a large number of items having a surface of constant size for example non-adhesive stickers are to be coated with adhesive. This approach can eliminate the need for the laborous, repetitive moistening of self-adhesive layers, as with postage stamps and can facilitate numerous sticking operations of the type in question in a clean and efficient manner.

According to the present invention, therefore, a hand stamp adhesive applicator for applying a liquid adhesive to a defined area on a surface is provided which includes a housing, an adhesive transfer stamp pad, a container, an adhesive applying stamp body, and a support mechanism for the stamp body. The housing includes a base and an upper part coupled to, and vertically displaceable with respect to, the base. The adhesive transfer stamp pad is supported in the housing and formed of a material permeable to the liquid adhesive. The container is also supported in the housing above, and in fluid communication with, the stamp pad. The adhesive applying stamp body applies the liquid adhesive to the defined area of the surface, and the support mechanism supports the adhesive applying stamp body in the housing for motion between an upwardly facing inoperative position to receive the liquid adhesive from the adhesive transfer stamp pad and a downwardly facing operative position to apply the liquid adhesive to the surface.

Also according to the present invention, a method of applying a liquid adhesive to an intended surface using a hand stamp adhesive applicator comprises the steps of:

(a) storing a liquid adhesive within a container supported in a housing of the applicator;

(b) retaining in a pore system of a porous, compressible adhesive transfer stamp pad a quantity of liquid adhesive transferred to the stamp pad from the container;

(c) transferring liquid adhesive from the pore system of the stamp pad to the outer surface of an adhesive applying stamp body made of a material non-permeable to the liquid adhesive when the stamp body is in an upwardly facing inoperative position in contact with a lower surface of the stamp pad; and (d) applying adhesive from the outer surface of the stamp body to the intended surface by moving the applicator at a right angle to the intended surface to thereby move the stamp body away from the stamp pad, rotate the stamp body 180° to a downward operative position and press the outer surface of the stamp body to the intended surface.

In order to use a hand stamp of the type discussed above for applying adhesive, it is merely necessary in accordance with the invention for the stamp pad to have a pore system extending throughout the pad, for a storage container containing a suitable liquid adhesive to be in fluid communication with the stamp pad, and also for the stamp body to be made of an impermeable and preferably non-rigid mateial of greater hardness than the constituent material of the stamp pad, the material also being easily wetted by the liquid adhesive. The stamp pad thus functions as an adhesive transfer pad, transferring liquid adhesive from the container to the stamp body, and the stamp body functions as an adhesive applying device, applying the liquid adhesive to the surface.

With such a construction, a suitable liquid adhesive continuously permeates through the fully porous stamp pad in such a way that, when the stamp body is pressed with sufficient force against the stamp pad, adhesive is transferred sufficiently liberally and uniformly from the stamp pad to the outer stamp surface of the stamp body. Forming the stamp body of harder material than the stamp pad ensures that the stamp surface of the stamp body is pressed a short way into the stamp pad in order to be sufficiently wetted with liquid adhesive from the depressed pore volume of the stamp pad. Since, in addition, the stamp body is made of material impermeable to the liquid adhesive, it also acts in its inoperative position as a seal against unwanted egression of the liquid adhesive from the stamp pad. In addition, it has been found that, providing a suitable liquid adhesive is used, the mutually contacting surfaces of the stamp pad and stamp body are in no danger of sticking to one another. Instead, in the inoperative position of the hand stamp, these surfaces are in permanent liquid or solution contact with the liquid phase in the adhesive storage container through the pore system extending throughout the stamp pad. This effectively prevents the adhesive from hardening in the region of the mutually contacting surfaces of the stamp pad and the stamp body.

The stamp pad together with its associated storage container may be replaceably arranged in the hand stamp in the manner of a cartridge, similar to known conventional hand stamps with a simple removable ink stamp pad.

In addition, a perforated partition may be provided between the open-pore stamp pad and its associated adhesive storage container in order to hold the stamp pad sufficiently against the counterpressure of the stamp body and to guarantee a uniform supply of adhesive to the stamp pad.

It may also be advisable to provide the stamp pad with an encircling, projecting rim into which the stamp body fits in the inoperative, rest position. Those surfaces of the projecting rim which face the stamp body are non-tacky with respect to the liquid adhesive used, or are made of a material which sticks as little as possible with the liquid adhesive. This provides for even better sealing of the adhesive-saturated stamp pad with the associated adhesive storage container in the inoperative position of the hand stamp.

In another embodiment, the stamp body may have such a large surface area that, in the inoperative rest position, it completely overlaps the rim surrounding the stamp pad and, in so doing, establishes a tight seal against undesirable egression and drying of the liquid adhesive. It can be advantageous for the rim surrounding the stamp pad not to project too far beyond the pad or, conversely, for the stamp pad to project slightly beyond the rim in its non-compressed state.

Finally, the adhesive storage container may also be fixedly arranged in the stamp housing and may be provided with a refill opening.

The hand stamp shown in the drawings is comprised of a housing which includes a housing-like (four-sided) base 1 and an upper part 4. Base 1 is designed to rest on a support 2 with a surface 3 to be stamped, for example a carton or the like. Upper part 4 extends on the front and back sides of the base 1, and upper part 4 has a top section 4*a* with downwardly directed lateral arms 5 which extend along the sides of top section 4*a*.

Lateral arms 5 are vertically displaceable along the outside of end walls 10 of base 1, while top portion 4*a* is displacable within the front and back walls of base 1. A guide rod 12 is pivotably connected to each end wall 10 of base 1 by a short link pin 13 for pivoting or swinging motion about pins 13. A stamp body 8 has a groove-like guide 15 extending from each of its sides, and is pivotably supported in base 1 by a pivot pin 7 which extends through pivot holes in guides 15.

Blind holes 6 are formed in the inside of the arms 5 to receive the ends of pivot pin 7. The ends of the pivot pin 7 also extend through vertical slots 9 in end walls 10 of base 1 and through accurate slot guides 11 in lateral guide rods 12. Each guide rod 12 is formed with an inwardly directed projection 14 which engages in groove-like guides 15 of stamp body 8. Two helical springs 16, shown in FIGS. 1 and 2, are arranged between base 1 and upper part 4, to force the two parts apart from one another in the inoperative, rest position illustrated in FIGS. 1 to 3.

In order to apply the liquid adhesive to an intended surface, upper part 4 is pressed downward with respect to base 1. During this downward motion upper part 4 carries stamp body 8 and pivot pin 7 downward, and pivot pin 7 is constrained to move in a linear downward direction by vertical slots 9 in ends walls 10 of base 1. Pivot pin 7 also moves downward through slot guides 11 of guide rods 12. As pivot pin 7 reaches the central curved area of slot guides 11, it slides against a surface of slot guides 11 and thereby pivots guide rods 12 in a clockwise direction as viewed in FIG. 4. The pivoting of guide rods 12 causes pins 14, which extend from rods 12, to also pivot and, thereby pivot guides 15 of stamp body 8 in a clockwise direction. This pivoting action continues as upper part 4 is moved further downward until pin 7 and pin 14 are aligned horizontally and stamp body 8 has pivoted 90°. Further downward motion of upper part 4 causes pivot pin 7 to pivot guide rods 12 in a counter-clockwise direction. With pivot pin 7 now moving downward below pins 14, the counter-clockwise pivoting of pins 14 in guides 15 of stamp body 8 cause the stamp body to continue its clockwise rotation until it reaches its downwardly facing position. Thus, when upper part 4 is depressed against the action of helical springs 16, stamp body 8 is moved downwardly from its upper position shown in FIG. 3 by means of the pivot pin 7, guides 15, projections 14 and guide rods 12 with accurate slot guides 11 and, during this downward movement, is turned through 180° until outer the stamp surface of the stamp body presses against the surface to be stamped, as shown in FIG. 4. In the preferred configuration the outer stamp surface of the stamp body is flat or unconfigured.

The foregoing detailed description of the drawings essentially corresponds to known hand stamps of the type which have been widely used for printing addresses, as date stamps or the like, wherein the stamp body or rather its base is surmounted by an ink-filled stamp pad against which the stamp body rests with its stamping surface in the inoperative position of the hand stamp.

In the adhesive applicator hand stamp according to the invention, the simple ink-filled stamp pad is replaced by a stamp pad 17 with an associated storage container 18 for liquid adhesive. Pad 17 and container 18 are arranged in a common housing 19, the actual stamp pad 17 and the storage container 18 being separated by a perforated partition 20 through which the liquid adhesive is able to flow continuously from storage container 18 into stamp pad 17 so that a quantity of the liquid adhesive is retained in a pore system extending throughout stamp pad 17. Container 18 and stamp pad 17 can be removably held in base 1 by friction engagement with, for example clips 30, as shown in FIG. 3. Alternatively, container 18 and stamp pad 17 can be permanently fixed in base 1 with a filing opening/valve 31 being provided in container 18, as shown in FIG. 1.

Liquid adhesives based on so-called solvent-activated adhesive systems have proved to be particularly useful for the present invention. It is possible to use corresponding liquid preparations both of firm-setting adhesives and of pressure-sensitive adhesives. Aqueous and/or water-miscible systems are preferred as the liquid phase, monohydric or polyhydric alcohols or water-miscible derivatives thereof being particularly suitable as water-miscible organic liquids. The actual adhesive substance used may be any of the known polymeric substances which are soluble in water or which form solutions and/or stable dispersions in aqueous systems and which are obtained from natural substances or as synthetic polymeric substances. Known adhesives of chemically modified natural substances are derived from starch and/or cellulose or cellulose derivatives. Dextrin-based adhesives are particularly preferred naturally derived materials. Examples of suitable water-soluble synthetic polymers are polyvinyl alcohol, polyvinyl ether, polyvinyl pyrrolidone and water-soluble polymeric derivatives of acrylic and/or methacrylic acid.

Non-stringing or substantially non-stringing liquid adhesives are particularly suitable. Particularly suitable liquid adhesives are those which have a viscosity at room temperature of at least about 2,000 mPAs; the viscosity of the liquid adhesives preferably not exceeding a value of about 10,000 mPas. The most preferred viscosity range for the liquid adhesives used in accordance with the invention is from about 2,000 to about 5,000 mPas.

The pore size of stamp pad 17 can vary depending on the viscosity of the liquid adhesive employed. For a given adhesive viscosity the pore size should be selected to provide for rapid, uniform transfer of adhesive through the pad to the stamp body. Too large a pore size will allow the adhesive to leak out of the pad when the stamp body is in the operative stamping position. Too small a pore size will not permit the passage of enough adhesive through the pad. Typically using materials having an average pore size of from about 200 to 1000 mμ and preferably about 300 to 800 mμ depending on the viscosity of the liquid adhesive can be employed. For a viscosity of 4000 mPas, it has been found that an open-cell foam having an average pore size of about 500 mμ and a unit weight of from 100 to 300 kg/m$^3$ is particularly suitable. The unit weight of an open-cell foam for stamp pad 17 is preferably in the range from 130 to 200 kg/m$^3$, with a unit weight of approximately 140 kg/m$^3$ being particularly suitable.

It is advisable to make stamp body 8 of a comparatively harder foamed material, the greater hardness being reflected in a greater unit weight, based on the particular material selected for the stamp body. Stamp body 8 also must be made of a material which is easily wetted by the liquid adhesive. The unit weight of a stamp body of foamed material is normally in the range from 180 to 400 kg/m$^3$, unit weights of from 200 to 300 kg/m$^3$ being particularly suitable, with a unit weight of 200 kg/m$^3$ being preferred. However, stamp body 8 may also be made of non-foamed elastomeric material which likewise performs the functions of taking up the adhesive from stamp pad 17 and applying it to the intended surface; and also of permanently sealing the cell containing the liquid adhesive in the inoperative position of the hand stamp. Stamp body 8 itself must not be permeable to the liquid adhesive, so that when stamp body 8 is made of foam, closed-cell foams preferably should be employed.

Suitable open-cell, porous materials for stamp pad 17 and closed-cell foams for stamp body 8 are any of the relevant foam plastics or foam rubbers which are inert to the liquid phase of the adhesive. Accordingly, corresponding foams based on polyurethane, crosslinked polyethylene, polyvinyl chloride, foam rubbers based on natural rubber or SBR-foams and the like are particularly suitable. Stamp body 8 may also be in the form of an elastomeric, optionally foam-backed molding having a smooth, compact transfer surface.

However, stamp pad 17 and/or stamp body 8 may also be made of any other suitable material, such as felt for stamp pad 17, in which case stamp body 8 is again preferably harder than stamp pad 17 so that the outer stamp surface of stamp body 8 is able to penetrate into stamp pad 17 far enough to guarantee an adequate and uniform transfer of adhesive from stamp pad 17 to the stamp surface. In addition, stamp pad 17 may be provided with a permeable covering, for example of linen cloth, which also promotes the uniform transfer of adhesive.

Housing 19 includes a projecting encircling rim 21 into which stamp body 9 is designed to fit. Since stamp body 8 is also preferably made of a foamed plastic material harder than the material of which stamp pad 17 is made, stamp body 8 compresses the stamp pad 17 by an amount Δh (see FIGS. 5 and 6) when it enters encircling lower rim 21 of the housing 19 which ensures that sufficiently large amount of adhesive is uniformly transferred from the pore system of stamp pad 17 to the outer stamping surface of stamp body 8.

When the hand stamp is operated by depressing upper part 3, stamp body 8 detaches itself from stamp pad 17, turns through 180° during its downward movement as previously described and, in its lowermost position (see FIG. 4), applies the adhesive thereon to the surface 3 to be stamped. Then, after upper part 4 has been released, stamp body 8 returns under the action of helical springs 16 to its upwardly facing, inoperative position in which it seals off stamp pad 17 and storage container 18 above the pad. In its upwardly facing, inoperative rest position, stamp body seals in the liquid adhesive within stamp pad 17 and container 18 when it is received in encircling rim 21. Alternatively, as shown in dash line on the left side FIG. 5, rim 21 can be made approximately flush with the lower surface of stamp pad 17 or pad 17 can extend slightly below rim 21, and stamp body 8 can be made sufficiently large to overlap rim 21 and seal stamp pad 17 in its inoperative position. The inner surfaces of lower rim 21 of housing 19 are preferably lined with non-adhesive or with only very slightly adhesive material to prevent stamp pad 17 and stamp body 8 from sticking to one another in the inoperative, rest position. It was surprisingly found that, providing liquid adhesives of the above-mentioned type are used, stamp body 8 and stamp body 17 do not stick to one another in the inoperative, rest position of the hand stamp to such an extent that subsequent separation of the two parts from one another would be seriously impeded.

The embodiment described in the foregoing may of course be modified in various ways without exceeding the scope of the invention. Thus, the drive mechanism of the hand stamp may be designed in any other suitable manner. The stamp pad and stamp body may also be made of various suitable materials, for example felt for the stamp pad, in which case the constituent material of the stamp body is again harder than that of the stamp pad to guarantee adequate transfer of adhesive from the stamp pad to the stamp body through corresponding partial compression of the stamp pad. To increase its uptake of adhesive, the stamp body could even be made of an open-pore material provided that, in the rest position of the stamp, a lower baseplate of the stamp body 8 bears sealingly against the projecting lower rim 21 of the housing 19 or the like. A separate vent valve for the adhesive storage container is generally not necessary because the container is sufficiently ventilated as the adhesive level falls by the open pore system of the stamp pad.

It can be seen that, using a hand stamp adhesive applicator according to the invention, adhesive can be applied particularly precisely, uniformly and cleanly. The use of the hand stamp adhesive applicator according to the invention is not confined to the sticking-on of parts of the same size as the stamp body. On the contrary, the hand stamp adhesive applicator according to the invention may be used for many other applications, for example for sticking-on parts of greater surface area by applying a layer of adhesive beforehand to the substrate in the corners of the part to be stuck on. For example, in the case of large-size address labels for parcels and the like, it would no longer be necessary to provide a self-adhesive coating which requires moistening and is generally difficult to use and may result in soiling.

Although certain embodiments of the invention have been described in detail, it will be appreciated that other embodiments are contemplated, along with modifications of the disclosed features, as being within the scope of the invention, which is defined in the appended claims.

We claim:

1. A method of applying a liquid adhesive to an intended surface using a hand stamp adhesive applicator comprising the steps of:

(a) storing a liquid adhesive within a container supported in a housing of the applicator;

(b) retaining in a pore system of a compressible adhesive transfer stamp pad a quantity of liquid adhesive transfered to the stamp pad from the container;

(c) transfering liquid adhesive from the pore system of the stamp pad to an outer surfce of an adhesive applying stamp body made of a material non-permeable to the liquid adhesive when the stamp body is in an upwardly facing inoperative position in contact with a lower surface of the stamp pad; and (d) applying the adhesive from the outer surface of the stamp body to the intended surface by moving the applicator at a right angle to the intended surface to thereby move the stamp body away from the stamp pad, rotate the stamp body 180° to a downward operative position and press the outer surface of the stamp body to the intended surface.

2. The method of claim 1 wherein said quantity of the liquid adhesive is retained within the pore system of an open-cell foam stamp pad having a unit weight of from about 100 to about 300 kg/m$^3$ by holding the outer surface of the stamp body against the stamp pad.

3. The method of claim 1 wherein said quantity of the liquid adhesive is retained within the pore system of an open-cell foam stamp pad having a unit weight of from about 130 to about 200 kg/m$^3$ by holding the outer surface of the stamp body against the stamp pad.

4. The method of claim 1 wherein step (c) includes compressing the stamp pad with the stamp body to attain a substantially uniform transfer of the liquid adhesive from the stamp pad to the stamp body.

5. The method of claim 1 or 4 wherein said stamp body is formed of a closed-cell foam having a unit weight of from about 180 to about 400 kg/m$^3$.

6. The method of claim 1 or 4 wherein said stamp body is formed of a closed-cell foam having a unit weight of from about 200 to about 300 kg/m$^3$.

7. The method of claim 1 wherein said liquid adhesive is non-stringing or substantially non-stringing.

8. The method of claim 1 wherein said liquid adhesive has a viscosity at room temperature of from about 2000 mPas to about 10,000 mPas.

9. The method of claim 1 wherein said liquid adhesive has a viscosity at room temperature of from about 2000 to about 5000 mPas.

10. The method of claim 1 wherein said liquid adhesive contains an aqueous and/or water-miscible liquid phase.

11. The method of claim 1 wherein said liquid adhesive contains pressure-sensitive and/or firm-setting polymeric adhesive compounds.

12. The method of claim 1 wherein said liquid adhesive contains starch- and/or cellulose-based adhesive compounds.

13. The method of claim 1 wherein said liquid adhesive contains an adhesive compound comprising synthetic polymers selected from the group consisting of polyvinyl alcohol, polyvinyl ether, polyvinyl pyrrolidone, polyacrylate, polymethacrylates and mixtures thereof.

14. The method of claim 1 including the steps of providing a perforated partition between the stamp pad and the container and compressing the stamp pad against the perforated partition with the stamp body to attain a substantially uniform transfer of the liquid adhesive from the stamp pad to the stamp body.

15. The method of claim 1 wherein said stamp pad includes an encircling rim into which said stamp body fits in its inoperative position.

16. The method of claim 1 wherein said stamp pad includes an encircling rim and said stamp body overlaps with and seals the rim in its inoperative position.

* * * * *